United States Patent [19]

Bonassi

[11] 4,443,032

[45] Apr. 17, 1984

[54] LOCK FOR BOAT HATCHES OPERABLE BOTH FROM INSIDE AND OUTSIDE

[75] Inventor: Luciano Bonassi, Saronno, Italy

[73] Assignee: C.M.L. Construzioni Meccaniche Lamazzo S.p.A., Lomazzo, Italy

[21] Appl. No.: 353,590

[22] Filed: Mar. 1, 1982

[30] Foreign Application Priority Data

Jul. 7, 1981 [IT] Italy ..... 22292/81[U]

[51] Int. Cl.[3] ..... E05C 3/04

[52] U.S. Cl. ..... 292/202; 292/DIG. 27

[58] Field of Search ..... 292/202, 207, 359, DIG. 27

[56] References Cited

U.S. PATENT DOCUMENTS 3,381,990 5/1968 Kreger ..... 292/114 X

*Primary Examiner*—Richard E. Moore

*Attorney, Agent, or Firm*—Michael J. Striker

[57] ABSTRACT

A lock for boat shutters and the like comprising a shaft, extending through a shutter, with a means thereon providing a square seat at one end, for operation by winch handle, and a hex head at the other end; a handle having a cam engageable with a shutter frame and an opening which receives the shaft therethrough; and a spring-biased knob inserted into the handle and having a hex cavity to receive the hex head of the shaft; the handle having recesses which receive, in one position of the knob, mating projections on the knob to operatively connect the shaft with the cam, and wherein, in a second position of the knob, the recesses and projections are disengaged so that the shaft is disconnected from the cam.

5 Claims, 2 Drawing Figures

LOCK FOR BOAT HATCHES OPERABLE BOTH FROM INSIDE AND OUTSIDE

BACKGROUND OF THE INVENTION

The present invention refers to a lock, to be used particularly on boat hatches and alike, which can be operated both from outside and from inside, in order to open or close the movable shutter of a hatch, relatively to its fixed frame. In particular, in this lock it is optional to make operative or inoperative, according to circumstances, the outside operation while retaining at all times the inside one.

Locks of this type are already known, but they require a complex manipulation in order to make inoperative the outside operation. A further disadvantage of the existing locks is due to the fact that the outside operation is performed either by means of a special handle which is an integral part of the lock itself, thus increasing its cost, or by means of a special key, with all the related inconveniences, such as, for instance, the loss of the key.

SUMMARY OF THE INVENTION

The object of the present invention is intended to prevent all these inconveniences and is designed in such a way as to make impossible the outside operation by means of simple and quick actions. In fact the outside operation can be performed by means of the square pin of a common winch handle thus reducing the cost of the lock itself.

The lock is characterized by the existence, on the internal side of the shutter, of a knob axially movable in contrast of a recalling spring and provided with two distinct ribs that can insert themselves into the corresponding notches existing in the handle.

This knob, moreover, is provided with an exagonal cavity which can engage the corresponding exagonal head at the extremity of a shaft, which inserts itself from outside and is provided at the other extremity with a circular plate, in turn provided with a seat for insertion of the square of a winch handle.

All is arranged in such a way that, when the above mentioned ribs are inserted in the corresponding handle notches, the exagonal cavity of the knob engages the corresponding exagonal head of the shaft.

A rotatory movement given to the shaft from outside, using the square pin of a handle crank, is transmitted to the internal handle, thus permitting the outside operation of the lock. Conversely, when the knob is in a retracted position (and the ribs do not engage the handle) the hexagonal head is disinverted from the corresponding hexagonal cavity and therefore an eventual rotation of the shaft connected to the external plate is not transmitted to the handle itself.

In this case the handle cannot be operated from outside, while the position of the knob does not prevent in any way the locking operation from inside.

The knob, which has axial freedom of movement, is fixed, however, to the shaft by means of a screw which only partially engages the internal threading existing in the shaft itself. This is so because of a tubular metallic screw-cover, which partially covers the stem of such screw and over which runs a recalling spring to keep the knob in position.

Figure 1:
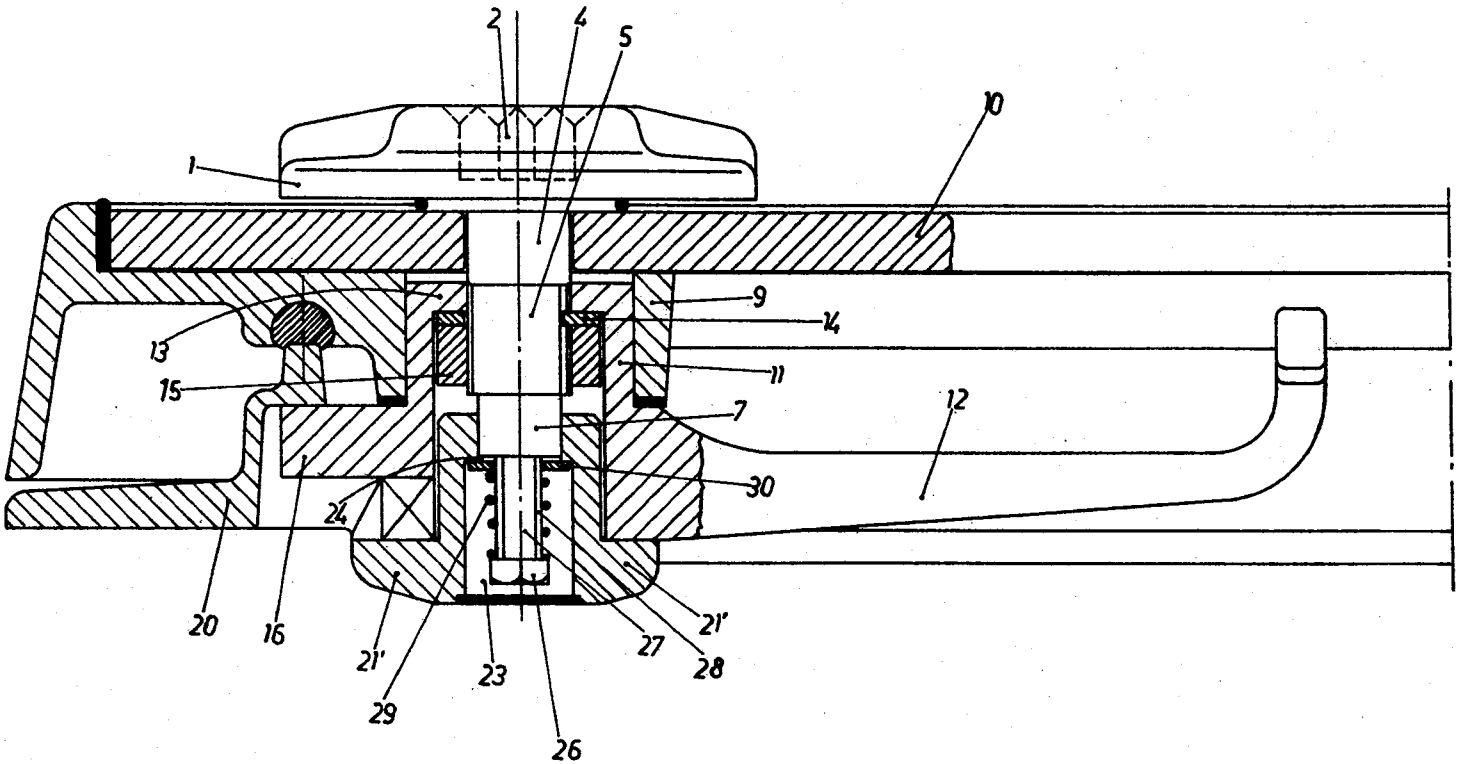
FIG. 1 shows an axial section of the invented lock in shutting position.

With reference to these figures, it can be seen that the lock of the present invention is composed of a circular metallic plate 1, positioned outside a glass 10 of the movable shutter, over which, towards the outside, is drawn a lodgment 2 for the insertion of the square pin of a winch handle and, towards the inside a shaft 3, circular in section, which presents a first smooth portion 4, an intermediate threaded portion 5, having a continuous cut 6 along the entire threading and ending with a hexagonal head 7, in the interior of which a threaded hole exists, coaxial with the shaft 3. This shaft 3 is inserted within a tubular sleeve 9, preferably of plastic material, jointed and fixed along a hole made in plate 10 supported by the movable shutter.

Between shaft 3 and sleeve 9, therefore, a cylindrical interspace is formed where an inner tube 11 is housed. This tube is of metallic material, constitutes integral part of the handle 12 and is oriented according to the axis of shaft 3.

The internal hole of tube 11, towards its free extremity, presents a narrowing in the diameter which acts as a support for a washer 14, inserted between shaft 3 and tube 11. This washer 14 is suitable both to prevent spontaneous unscrewing of a sleeve 15, internally threaded, which screws itself around the same shaft 3, and to prevent the slipping out of this sleeve from the shaft itself. In this way tube 11 of handle 12 is free to rotate around shaft 3 without being tied up to it, while its external surface adheres to the internal surface of sleeve 9.

On the handle 12 is also fitted a cam 16 of plastic material, acting as a latch. The cam is firmly seated by means of pasting of welding along a line 17—partially visible in FIG. 2—and also by means of the joint of a stopper 18 protruding from cam 16, in a cavity 19 predisposed on the handle itself. This cam 16, rigidly connected to handle 12, rotates together with the handle itself during the operation of closing and opening the movable shutter. In particular in the closing operation, it engages the fixed frame 20—partially visible in FIG. 1—thus securing the shutter.

Figure 2:
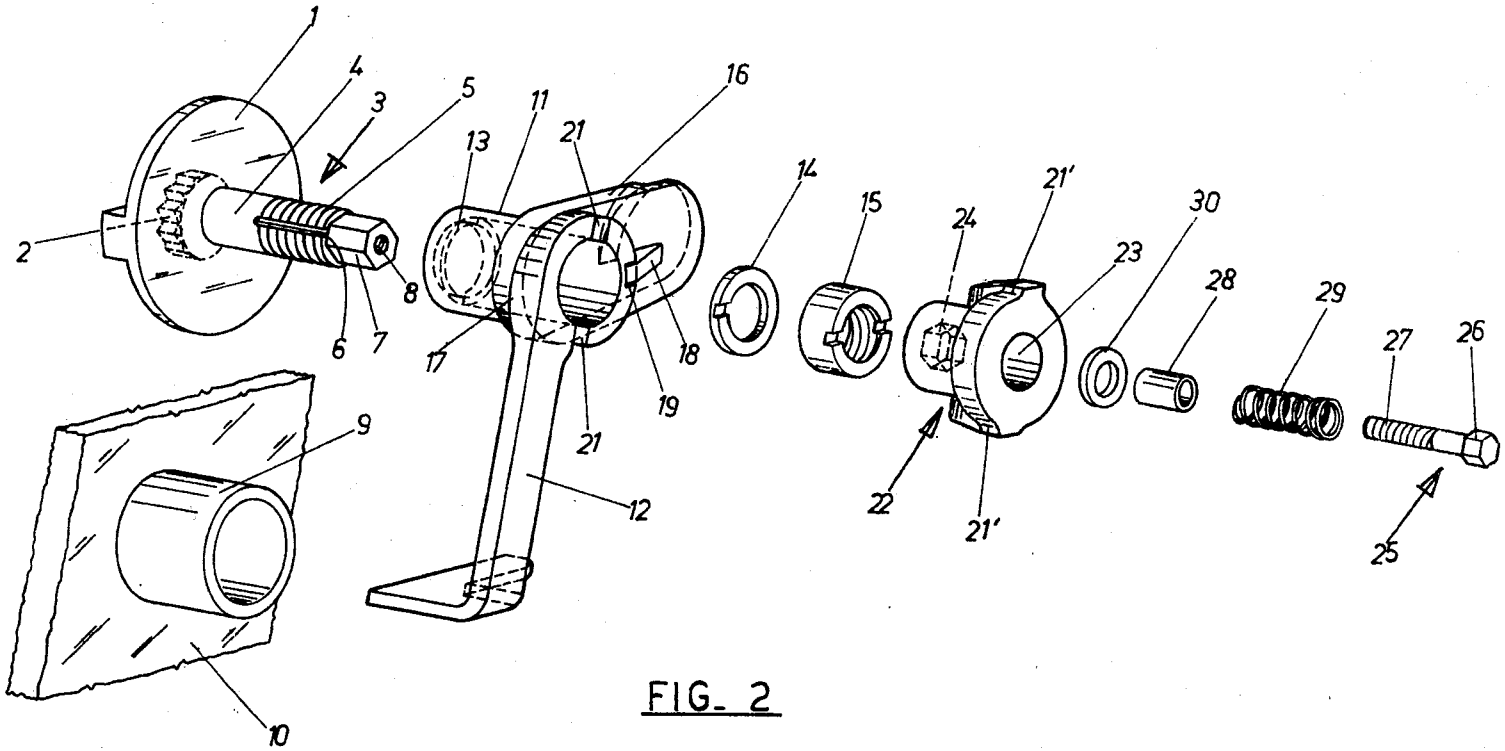
FIG. 2 shows an exploded assonometric view of the lock in FIG. 1.

As a rule, cam 16 is perpendicular to handle 12, as indicated in FIG. 2. This cam has been reproduced in FIG. 1 as a prolongation of the handle only to make the drawing easier. Handle 12 is also provided with two more cavities 21, diametrically opposed, where the two protruding wings 21' of a plastic knob 22 may insert be inserted. This knob 22 has a circular passing hole 23, which on the side opposite to wings 21' narrows and becomes hexagonal in shape—24—and engages the hexagonal head 7 of shaft 3 when wings 21' are inserted in the respective cavities 21 of the handle.

In the hole 23 of knob 22, a screw 25, having a hexagonal head 26, may be inserted. Its stem 27, crossing also 24, goes to screw in the threaded hole 8 existing in shaft 3. Around this stem 27 of the screw 25, a metallic screw-cover 28 is predisposed, having an external diameter smaller than the dimensions of head 26, so that only a partial screwing of stem 27 is permitted in the hole of shaft 3.

Around this screw cover 28, a spring 29 and a metallic washer 30 run, having an external diameter exceeding the maximum dimension of 24, so that the slipping out of knob 22 is prevented and, at the same time, the spring 29 is compressed against head 26 of screw 25 when the knob is in a retracted position. Shaft 3 and handle 12 remain engaged one to the other when wings 21' of knob 22 are inserted in the relevant cavities 21 existing on the handle. In this case, in fact, the hexagonal head 7 of shaft 3 is engaged with the cavity 24 of knob 22 and a rotatory motion of said shaft is transmitted to the handle (and vice versa) through the knob itself, thus making it possible the operation of opening and closing the shutter from outside. Should it be desirable to disengage shaft 3 from handle 12 to prevent outside operation by means of the square pin of a whinch handle, it is sufficient to pull back knob 22, disengaging wings 21' from cavities 21 and placing them by a rotation on the solid portion of the handle.

This operation also desengages the hexagonal head 7 of shaft 3 from the related cavity 24 existing in the knob so that this shaft turns idling when operated from outside. This, however, does not preclude the possibility of closing and opening the shutter from inside, which can be done by direct action on the command handle 12.

I claim:

1. A lock for boat shutters and the like operable both from outside and inside of the shutter to open and close a movable shutter with respect to a fixed frame of a hatch, comprising an outer circular plate having a seat for insertion thereinto a square pin of a winch handle, said plate being formed with a shaft extended axially outwardly therefrom and insertable into the shutter from outside, said shaft including a hexagonal head formed at its extremity opposite to said plate; a rotatable handle provided with an opening to receive said shaft therethrough; said handle being formed with a cam engageable with said fixed frame to lock the shutter and being provided with two diametrally opposing recesses; a knob inserted into said handle and provided with a hexagonal cavity in which the hexagonal head of said shaft is engageable, said knob being formed with two diametrally opposing projections engageable in said opposing recesses of said handle; and a spring biasing said knob in the axial direction thereof, said knob being axially shiftable between one position, in which said projections are engaged in said recesses of the handle and the hexagonal cavity engages said head of said shaft whereby a rotary movement given to said plate by the square pin of the winch handle from outside of the shutter is transmitted to said handle permitting a locking operation from outside, and another position, in which said projections are disengaged from said recesses and said cavity is disengaged from said hexagonal head of the shaft whereby the rotary movement of said plate can not be transmitted to said handle and the operation from outside of the shutter is prevented whereas a locking operation from inside of the shutter by rotation of said handle is permitted.

2. The lock as defined in claim 1, further including a screw passing through said knob, said shaft having an internal threaded opening receiving a portion of said screw.

3. The lock as defined in claim 2, further including a tubular metallic cover mounted on said screw and partially covering said screw, said cover limiting the insertion of said screw into said opening.

4. The lock as defined in claim 3, wherein said spring is mounted on said cover.

5. The lock as defined in claim 4, wherein said screw has a head, said spring being supported by said head.

* * * * *